US007000536B2

(12) United States Patent
Laitila et al.

(10) Patent No.: US 7,000,536 B2
(45) Date of Patent: Feb. 21, 2006

(54) BELT CALENDER

(75) Inventors: Markus Laitila, Järvenpää (FI); Mika Viljanmaa, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/257,688

(22) PCT Filed: May 3, 2001

(86) PCT No.: PCT/FI01/00419

§ 371 (c)(1),
(2), (4) Date: Jan. 28, 2003

(87) PCT Pub. No.: WO01/83884

PCT Pub. Date: Nov. 8, 2001

(65) Prior Publication Data

US 2004/0035302 A1 Feb. 26, 2004

(30) Foreign Application Priority Data

May 3, 2000 (FI) ..... 20001025

(51) Int. Cl.
*B30B 3/04* (2006.01)
*D21F 3/00* (2006.01)

(52) U.S. Cl. ..... 100/153; 100/38; 100/41; 100/155 R; 100/176; 100/314; 162/206; 162/358.4

(58) Field of Classification Search ..... 100/35, 100/38, 313, 314, 162 R, 153, 163 R, 162 B, 100/173, 176, 41, 327, 155 R; 162/206, 162/207, 358.3, 358.4, 358.5, 360.2, 360.3
See application file for complete search history.

(56) References Cited

U.S. PATENT DOCUMENTS

| | | | | |
|---|---|---|---|---|
| 5,163,364 | A * | 11/1992 | Bubik et al. | 100/38 |
| 5,483,873 | A | 1/1996 | Koivukunnas et al. | 100/38 |
| 6,027,615 | A * | 2/2000 | Davenport et al. | 162/358.2 |
| 6,065,396 | A * | 5/2000 | Schiel et al. | 100/153 |

FOREIGN PATENT DOCUMENTS

| | | |
|---|---|---|
| EP | 0837182 | 1/1999 |
| FI | 95061 | 8/1995 |
| WO | 9844196 | 10/1998 |

* cited by examiner

*Primary Examiner*—Derris H. Banks
*Assistant Examiner*—Jimmy Nguyen
(74) *Attorney, Agent, or Firm*—Steinberg & Raskin, P.C.

(57) ABSTRACT

The invention relates to a belt calender, comprising a first roll (11), a second roll (13; 15), and a belt loop therebetween, comprising an incompressible metal belt (12) pressed by the second roll (13; 15) against the first roll (11) to establish a calendering zone between the first roll (11) and said belt (12). The second roll (13; 15) is provided with a compressible belt section (14; 18) to be pressed against the metal belt (12).

4 Claims, 2 Drawing Sheets

BELT CALENDER

FIELD OF THE INVENTION

The invention relates to a belt calender, comprising a first roll, a second roll, and a belt loop therebetween, comprising an incompressible metal belt pressed by the second roll against the first roll to establish a calendering zone between the first roll and said belt.

The invention relates further to a method for calendering a web of material in a belt calender, comprising a first belt, a second belt, and a belt loop therebetween, comprising an incompressible metal belt pressed by the second roll against the first roll to establish a calendering zone between the first roll and said belt.

BACKGROUND OF THE INVENTION

In an effort to raise the level of calendering, the only practical possibility has been to increase the number of calendering nips. This has led to a more complicated calender construction and more difficult control and threading of the paper web. Particularly, in reference to on-line machines, a solution must be found to contradictions arising from high running speed and full-speed web threading. Attempts have been made to solve these problems with various belt and shoe calenders for extending a calendering nip to enhance thereby the nip operation. For example, paper to be calendered with belt calenders is carried by means of an endless belt to a preliminary contact with a hot calender roll, thus enabling the creating of a steep temperature gradient favourable from the viewpoint of calendering. By means of the belt, the effective length of a nip is extended by virtue of the preliminary contact as well as for the reason that the belt material enables the use of polymers which are considerably softer than those used in roll coatings, without problems resulting from deformations related to heat. With a nip more extended than in a supercalender or soft calender, the press impulse applied to the paper can be increased without the pressure peak becoming excessively high and without reducing the bulk.

One solution for a belt calender has been disclosed earlier e.g. in Finnish patent publication No. 95061. A calender embodiment according to this cited publication is shown schematically in FIG. 1 of the drawings, depicting the prior art.

In the prior art calender shown in FIG. 1, a calendering nip N is formed between a heatable hard roll 1 and a calendering belt, preferably a metal belt 5, supported by an elastic surface roll 2. The metal belt 5 is an endless belt and could be e.g. steel in its material. The belt has been extended over the nip roll 2 and a reversing roll 4, the former being lined with an elastic coating 3. In this prior art calender, the calendering nip N is formed between the heatable hard roll 1 and said metal belt 5 supported by the calender roll 2 lined with an elastic coating. Such a solution is largely consistent with the nip of a soft calender, wherein, however, the metal belt 5 enables both sides of a paper W to be subjected to a substantially identical treatment and, thus, the glazing to occur simultaneously on either side of the paper W.

OBJECTS AND SUMMARY OF THE INVENTION

It is an object of the present invention to provide an improved belt calender solution, capable of providing a long-nip calender, which further enables the application of a relatively high pressure. In order to accomplish this object, a belt calender of the invention, comprising a first roll, a second roll, and a belt loop therebetween, comprising an incompressible metal belt pressed by the second roll against the first roll to establish a calendering zone between the first roll and said belt, is characterized in that the second roll is provided with a compressible belt section to be pressed against the metal belt.

On the other hand, a method of the invention is characterized in that the first roll is constituted by a polymer-coated roll, the second roll is constituted by a roll which is provided with a compressible belt section to be pressed against a metal belt, the web of material to be calendered in said method being passed through a nip between the polymer-coated roll and the metal belt.

The invention provides a solution which enables a wide range of pressure control accompanied by a concurrent wide range of operating speeds. In addition, the use of an incompressible metal belt and a roll supporting the same at the nip and provided with a compressible belt enables the creation of a finishing zone, which has an extremely high-quality surface, is resilient and highly compliant with a web surface in accordance with loading. Other benefits and characterizing features of the invention shall be described in a more detailed specification hereinafter.

DETAILED DESCRIPTION OF THE INVENTION

Figure 1:
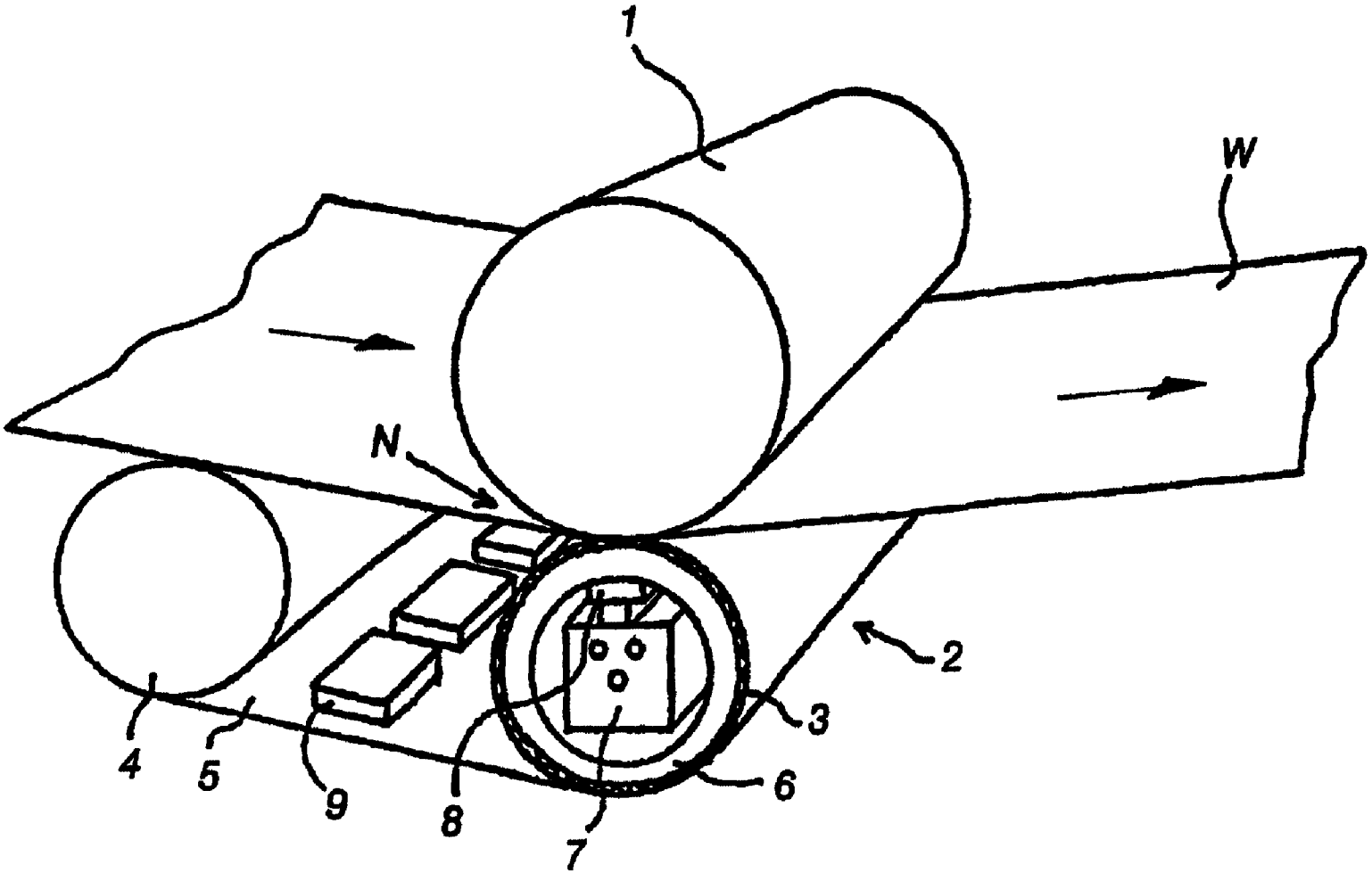
Fig.1 Prior Art
FIG. 1 shows a calender of the prior art, wherein a calendering nip is established by means of a heatable hard roll and an endless metal belt supported by a roll provided with an elastic coating.

The prior art belt calender arrangement of FIG. 1 comprises a roll 1 which is a heatable hard-surface roll, and a roll 2 which is a deflection-compensated roll provided with an elastic coating 3, wherein a roll shell 6 is adapted to rotate around a stationary roll shaft 7. The roll shell 6 is loaded towards a nip N with loading elements 8. Such a zone-controlled roll can be used for equalizing a loading on the nip N laterally of the web and the loading can be adjusted whenever necessary or desirable. Reference numeral 9 designates heating elements, e.g. induction heaters in the case of a metal belt 5. Reference numeral 4 indicates a guide roll, over which the metal belt 5 extends.

Figure 2:
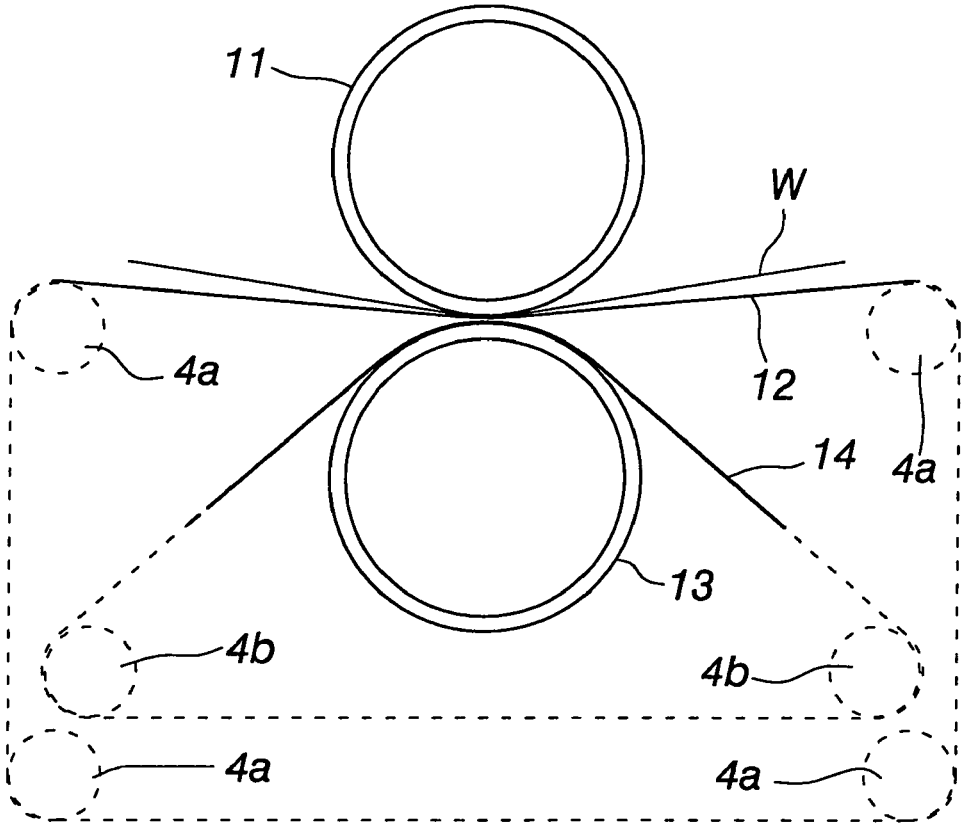
FIG. 2 shows in a schematic side view a calendering nip arrangement according to one embodiment of the invention.

FIG. 2 depicts one embodiment of the invention, wherein reference numeral 11 indicates a first roll, comprising e.g. a thermal roll or a polymer-coated roll. Reference numeral 13 refers to a second roll, comprising in the present embodiment a hard-surface roll, around which is adapted to run a compressible belt 14 which additionally extends over guide rolls 4. Between the rolls 11 and 13 extends an incompressible metal belt 12, which is adapted to be heatable, if necessary. A calendering nip N is formed between the first roll 11 and the metal belt 12. Reference character W refers to a web of material, which passes through the nip N.

Figure 3:
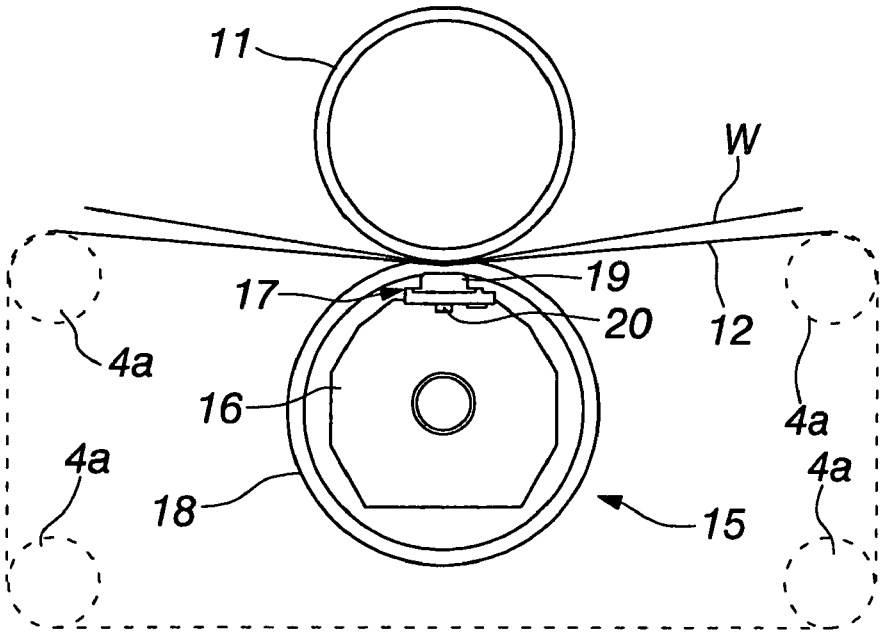
FIG. 3 shows a second calendering nip arrangement of the invention in a view similar to FIG. 1.

In FIG. 3, a first roll is likewise designated with reference numeral 11 and it may comprise either a polymer-coated roll or a thermo roll. On the other hand, reference numeral 15 is used for a shoe roll, wherein a stationary shaft 16 is provided with a loading element 17 in line with a nip N, comprising a shoe member 19 extending across the width of the nip, and pistons 20 applying a load thereto. A compressible belt shell 18 is adapted to extend around the shoe 19. As in the case of the guide rolls 4a shown in FIG. 2, an incompressible metal belt 12 is adapted to extend through between the roll 11 and the second roll 15 to establish the nip N between the metal belt 12 and the first roll 11, a web of material W passing through said nip N.

When the first roll in a belt calender of the invention comprises a polymer-coated roll, the metal belt is adapted to be heatable. Respectively, when the first roll 11 comprises a heatable chilled roll, a so-called thermo roll, the metal belt 12 is preferably adapted to be cooled with known techniques.

One benefit gained by a solution of the invention is that a resilient or elastic belt can be provided with substantially softer polymers than in a polymer-coated roll, whereby the nip can be extended. In addition, the belt calender of the invention enables the establishment of a nip between a polymer-coated roll and a metal belt.

What is claimed is:

1. A belt calender, comprising:

a first roll (11), a second roll (13; 15), and a belt loop arranged between said first and second roll, said belt loop comprising an incompressible metal belt (12) pressed by the second roll (13; 15) against the first roll (11) to establish a calendering zone between the first roll (11) and said incompressible metal belt (12), wherein the first roll (11) comprises a polymer-coated roll and the second roll (13; 15) is provided with a resiliently compressible belt section (14; 18) to be pressed against the incompressible metal belt (12), the belt calender for treating both sides of a web simultaneously in the calendering zone, and wherein the incompressible metal belt extends over a plurality of guide rolls; and wherein the resiliently compressible belt section having a compressible belt extends over a plurality of guide rolls, and the compressible belt is pressed by the second roll against the incompressible metal belt.

2. A belt calender as set forth in claim 1, wherein the metal belt (12) is adapted to be heatable and/or coolable.

3. A method for calendering a web of material in a belt calender comprising the steps of:

arranging a first roll and a second roll and a belt around said second roll, wherein said belt comprises an incompressible metal belt;

pressing said belt by said second roll against said first roll such that a calender zone is defined between the first roll and said belt;

wherein said first roll comprises a polymer-coated roll and said second roll is provided with a resiliently compressible belt section to be pressed against said metal belt; and passing a web of material through a nip defined between the polymer coated and the metal belt to treat both sides of the web simultaneously in the calendering zone, and wherein the incompressible metal belt extends over a plurality of guide rolls; and wherein the resiliently compressible belt section having a compressible belt extends over a plurality of guide rolls, and the compressible belt is pressed by the second roll against the incompressible metal belt.

4. The method as set forth in claim 3, wherein said metal belt is one of heatable and coolable.

* * * * *